US008210513B2

(12) United States Patent
Latvakangas et al.

(10) Patent No.: US 8,210,513 B2
(45) Date of Patent: Jul. 3, 2012

(54) BINDING MACHINE A CASSETTE MACHINE AND BOOKLET BINDING METHOD

(75) Inventors: Urpo Latvakangas, Saltsjö-boo (SE); Göran Tolf, Täby (SE); Jan Sabelström, Huddinge (SE)

(73) Assignee: Bindomatic AB, Stockholm (SE)

( * ) Notice: Subject to any disclaimer, the term of this patent is extended or adjusted under 35 U.S.C. 154(b) by 615 days.

(21) Appl. No.: 12/310,965

(22) PCT Filed: Sep. 13, 2007

(86) PCT No.: PCT/SE2007/050649
§ 371 (c)(1),
(2), (4) Date: Mar. 13, 2009

(87) PCT Pub. No.: WO2008/033092
PCT Pub. Date: Mar. 20, 2008

(65) Prior Publication Data

US 2010/0021269 A1 Jan. 28, 2010

(30) Foreign Application Priority Data

Sep. 14, 2006 (SE) ..... 0601896-4

(51) Int. Cl.
*B65H 37/04* (2006.01)

(52) U.S. Cl. ..... 270/58.07; 412/37; 412/19; 412/4

(58) Field of Classification Search ..... 270/58.07, 270/58.08; 271/170; 412/4, 5, 19, 37
See application file for complete search history.

(56) References Cited

U.S. PATENT DOCUMENTS

| | | | | |
|---|---|---|---|---|
| 2,962,733 | A | 12/1960 | Kramer et al. | |
| 3,126,122 | A | 3/1964 | Sacre | |
| 3,306,491 | A | 2/1967 | Eisner et al. | |
| 5,626,334 | A * | 5/1997 | Kondo et al. | 271/121 |
| 6,199,851 | B1 | 3/2001 | Latvakangas et al. | |
| 6,213,456 | B1 * | 4/2001 | Hirano et al. | 270/58.08 |
| 6,217,271 | B1 | 4/2001 | Latvakangas et al. | |
| 6,685,416 | B2 * | 2/2004 | Itoh et al. | 412/37 |

(Continued)

FOREIGN PATENT DOCUMENTS

GB 1 200 484 7/1970

(Continued)

OTHER PUBLICATIONS

International Search Report for PCT/SE2007/050649, mailed Jan. 29, 2008.

*Primary Examiner* — Patrick Mackey
(74) *Attorney, Agent, or Firm* — Nixon & Vanderhye PC

(57) ABSTRACT

The present invention relates to a booklet binding machine (201). The machine includes cassette receiving means (202, 203), an infeed mechanism (206) a combining unit and an activating unit. According to the invention, the cassette receiving means is adapted to receive a cassette pack in which the booklet covers are disposed in a bundle in a non-folded state in the cassette. The machine also includes means (211, 212, 213) for folding the booklet covers along two fold lines. The invention also relates to a cassette pack which includes an infeed cassette and a bundle of booklet covers in the cassette. According to the invention, the booklet covers are in a non-folded state in the cassette. Each booklet cover includes fold lines and an activatable adhesive. The invention also relates to a booklet binding method.

18 Claims, 6 Drawing Sheets

U.S. PATENT DOCUMENTS

| | | | | |
|---|---|---|---|---|
| 6,866,459 | B2 * | 3/2005 | Cobene et al. | 412/4 |
| 7,413,179 | B2 * | 8/2008 | Honmochi et al. | 270/58.11 |
| 2004/0041329 | A1 | 3/2004 | Hiraoka | |
| 2006/0153612 | A1 | 7/2006 | Saitsu et al. | |
| 2006/0180998 | A1 | 8/2006 | Lee et al. | |

FOREIGN PATENT DOCUMENTS

| | | |
|---|---|---|
| SE | 506 022 | 11/1997 |
| SE | 506 217 | 11/1997 |
| WO | WO 98/14333 | 4/1998 |

* cited by examiner

BINDING MACHINE A CASSETTE MACHINE AND BOOKLET BINDING METHOD

This application is the U.S. national phase of International Application No. PCT/SE2007/050649, filed 13 Sep. 2007, which designated the U.S. and claims priority to Sweden Application No. 0601896-4, filed 14 Sep. 2006, the entire contents of each of which are hereby incorporated by reference.

FIELD OF INVENTION

According to a first aspect, the present invention relates to a booklet binding machine where each booklet includes a cover that has a front side, a rear side and a spine situated between said sides and a number of sheets, such as sheets of paper, enclosed in the cover and adhered to the spine of the cover, wherein the machine includes

- At least one cassette receiving element which is adapted to receive a cassette pack which includes a cassette in which there is provided a bundle of booklet covers, where each booklet cover includes fold lines in an activatable adhesive;
- An infeed mechanism which is adapted to feed the booklet covers from the cassette into the machine one at a time;
- A combining unit which is adapted to combine a plurality of sheets with a booklet cover fed from the machine;
- An actuator for activating the adhesive for fastening the sheets to the booklet cover.

The invention also relates to a cassette for a bundle of sheets, which sheets are intended for being feeded one by one from the cassette, which cassette substantially has the shape of a parallelepipedic box with a feed side including a feed opening.

According to a second aspect the invention relates to a cassette pack which includes an infeed cassette and a bundle of booklet covers, wherein the cassette pack is adapted for use in accordance with a first aspect of a machine according to the present invention.

In a third aspect the invention relates to a booklet binding method wherein each booklet includes a cover that has a front side, a rear side and a number of sheets, such as sheets of paper enclosed in the cover and glued to its spine, wherein the method comprises feeding the booklet covers to the machine one at a time from a cassette, wherein each booklet cover includes fold lines and an activatable adhesive; combining a plurality of sheets with a booklet cover fed into the machine; and activating the adhesive such as to fasten the sheets to the booklet cover.

BACKGROUND OF THE INVENTION

It has long been known to bind booklets in accordance with the method described above and with the aid of a binding machine of the kind described above. Examples of such methods and such machines are found in EP581314 and EP0879150.

According to an earlier known technique each booklet cover is always fed in a folded state, i.e. roughly as it appears when it constitutes a cover for a finished booklet or with the front side and the rear side folded outwards somewhat, so that the booklet cover will have a U-shape cross-section. The booklet covers are delivered in a cassette in which the covers are already folded in this way and fed out from the cassette. This technique has been found to be reliable and expedient and provides a cost effective booklet binding procedure for both small and large binding series. Because the booklet covers are disposed folded in the cassette in which they are delivered and from which they are fed into the machine it means that packing of the booklet covers in the cassette is somewhat space demanding. Another draw-back is that feeding of the folded booklet covers into a machine requires the use of particular infeed means in the form of suction cups which grip the booklet cover to be fed into the machine. Such an infeed mechanism complicates the machine by requiring the presence of pneumatic means.

The object of the present invention is to avoid said drawbacks and to provide a simple and more effective booklet binding means.

SUMMARY OF THE INVENTION

This object is achieved according to a first aspect of the invention with the aid of a binding machine of the kind concerned which has the special features that enable the receiving device to receive a cassette pack in which the booklet covers are disposed in a bundle in the cassette in a non-folded state, and wherein the machine includes a device for folding the booklet covers along two fold lines on respective booklet covers.

Because the binding machine is adapted to receive a cassette pack in which the booklet covers are in a non-folded state it is possible to deliver booklet covers in a cassette in this state. This enables the space to be used more effectively in each cassette.

By providing the machine with a folding device, the booklet covers can be fed to the machine in a non-folded state. The infeed of a non-folded booklet cover, i.e. a generally flat booklet cover, from a bundle of booklet covers can be carried out in a simpler fashion than when the booklet covers are fed-in in a folded state. The folders may also be fed into the machine pneumatically, which makes the procedure simpler to carry out. The essential benefit, however, is that it allows the whole of the infeed process to be achieved mechanically. This reduces the complexity of the machine and increases reliability.

According to one preferred embodiment of the inventive binding machine, the folding device is designed to fold a booklet cover prior to the placement of sheets in the cover, such that the combination of the sheets with the booklet cover results in the introduction of the sheets therein.

This facilitates combination of the sheets with a booklet cover, by virtue of the front and the rear sides of the booklet cover functioning as a guide for the sheets combined with the cover.

According to another preferred embodiment of the invention, the folding device includes a guide plate which is adapted to guide a leading end edge of the booklet cover in a given path as the booklet cover is fed in.

This embodiment results in a very simple and reliable folding device in the absence of any movable parts in addition to the infeed mechanism.

According to another preferred embodiment of the invention, the guide plate has a portion which is curved in a plane at right angles to the movement direction of the leading end edge and with the concave side of the plate facing towards said end edge.

This configuration permits a continuous and harmonic change in the movement direction of the end edge so that this step of the folding process will be free from disturbance.

According to another preferred embodiment of the invention, the guide plate includes a device which functions to stop the movement of the end edge prior to the full insertion of the booklet cover.

With the aid of the stop means, the folding sequence is divided into two steps such as to enable movement of the end edge to be stopped very readily in combination with continued outfeed of the booklet cover, wherewith the presence of fold lines means that the booklet cover will be readily forced into a folded state.

According to one preferred embodiment of the invention, the machine is adapted to combine one sheet at a time with the booklet cover.

A binding machine of this particular kind normally co-acts with another office machine, such as a printer or copier from which the sheets to be included in the booklet are fed out one at a time. By arranging the binding machine so that the sheets are combined with the booklet cover one at a time, there is no longer need to equip the binding machine with a separate sheet collecting or gathering device prior to the sheets being combined with the booklet cover.

This contributes to a simple machine.

According to another preferred embodiment of the invention, the infeed mechanism includes a feed roller which is adapted for rolling abutment with the one side of the outermost booklet cover in the booklet cover bundle, and further includes a resilient pressure element which is adapted to press against the booklet cover bundle on its opposite side.

This results in a simple and convenient infeed mechanism which minimizes the risk of erroneous infeed.

The object of the invention is also achieved in accordance with a second aspect by virtue of the cassette pack of the kind in question including non-folded booklet covers which are provided with at least two fold lines and an activatable adhesive.

The inventive cassette pack provides a means which enables the booklet covers to be readily advanced in a non-folded state in a binding machine designed for the handling of booklet covers. This affords benefits of a kind corresponding to those given above with respect to a thus designed binding machine. A cassette pack of this kind is also more space saving than cassettes in which the booklet covers are typically in a folded state.

According to one preferred embodiment of the inventive cassette pack the cassette has the form of a parallelepiped box and an opposing bottom side wherein the feed side includes a feed opening which is provided with a separating element for separating a booklet cover for remaining booklet covers in the bundle.

By providing the feed opening of the cassette with such a separating element, it is possible to feed out the booklet covers one at a time without needing to provide the binding machine with separate devices to this end. This simplifies the binding machine and reduces the risk of malfunctioning of the machine.

According to another preferred embodiment of the invention, the feed opening is delimited by a first opening adjacent one end of the feed side, wherein the first opening edge forms a corner with each laterally located opening edge, wherein at least one of the corners has fastened thereto an element which projects out slightly into the feed opening and forms said separating element.

A so-arranged element enables a booklet cover to be separated from the remaining bundle of booklet covers in a very simple and reliable fashion. According to another preferred embodiment of the invention, the bottom side of the cassette is provided with an opening which enables the passage of a pressure element included in the binding machine.

This readily facilitates pressing of the booklet cover bundle towards the feed opening so that its separating element will be caused to co-act with a booklet cover that is to be separated and fed in.

According to another preferred embodiment of the invention, the cassette includes a movable support plate disposed between the bundle of booklet covers and the bottom side.

This support plate facilitates the achievement of an evenly distributed pressure force on the bundle of booklet covers, therewith enhancing the reliability of the booklet cover separating function.

According to another preferred embodiment of the invention, the feed opening is adapted to enable booklet covers to be fed in a direction perpendicular to the fold lines. The infeed direction of the booklet cover creates conditions which will enable the booklet cover to be folded in the binding machine with the aid of a relatively simple device.

According to another preferred embodiment of the invention, the cassette is also adapted to provide for packing a bundle of booklet covers therein.

This twin function of the cassette eliminates the need for a separate packaging unit and also for the handling or requirement which necessitates the removal of booklet covers from a pack of covers and loading them in a feed cassette. This also avoids the risk of erroneous charging of the booklet covers.

According to a third aspect of the invention, the object mentioned above is achieved with a method of the kind concerned which includes the particular measures of feeding each booklet cover into the binding machine in a non-folded state and by folding each cover in the machine.

According to preferred embodiments of the inventive method the method is carried out in a binding machine according to the present invention or with the aid of preferred embodiments thereof and/or with the aid of a cassette-pack according to the present invention or according to any of the preferred embodiments thereof. The inventive method and the preferred embodiments of said method provide benefits of a kind corresponding to the benefits afforded by the inventive binding machine and the inventive cassette pack and the preferred embodiments thereof.

A cassette of the kind initially described usually is used for feeding sheets, e.g. paper sheets out therefrom for treatment in a machine. The sheets can e.g. be unfolded booklet covers with fold lines and an applied string of adhesive when it concerns a machine according to the present invention. The sheet alternatively can be folded so that they already in the cassette form folded booklet covers. The sheets can also be completely planar unworked sheets, e.g. sheets for printing or copying such as for example when the sheets are feeded from the cassette to a printing press, copy machine, printer or photoprinter.

When such sheets are to be feeded into a machine of any of the above mentioned kinds or of a similar kind, the machine is usually provided with some kind of separating device that assures that only one sheet at a time is feeded into the machine. This results in that the intake mechanism of the machine becomes relatively complicated.

The object of the present invention therefore also is to generally make it possible to simplify the machine in question regarding infeeding of the sheets into the same.

According to the invention this is achieved in that a cassette of the kind in question includes the specific feature that the feed opening of the cassette is provided with separating means for separating one sheet from the other sheets in the bundle. Thanks to that the cassette as such is provided with such separating means, the need to provide a separating device on the machine that are to treat the sheets is eliminated or at least make it possible to make the machine in question more simple with regards to the in feeding of sheets into the same.

According to a preferred embodiment of the invented cassette the feed opening of the cassette is limited by a first opening edge at one end of the feed side, which opening edge forms a corner with each of a laterally positioned opening edge, whereby in at least one of the corners is attached a separating element which projects out into the feed opening and forms said separating means.

A separating element makes it possible to obtain the separation of one sheet from the remainder of the bundle in a simple and reliable way.

The present invention will now be described in more detail with reference to the following detailed description of a beneficial embodiment of the invention and also with reference to the figures of the accompanying drawings.

DESCRIPTION OF EMBODIMENTS AT PRESENT PREFERRED

Figure 1:
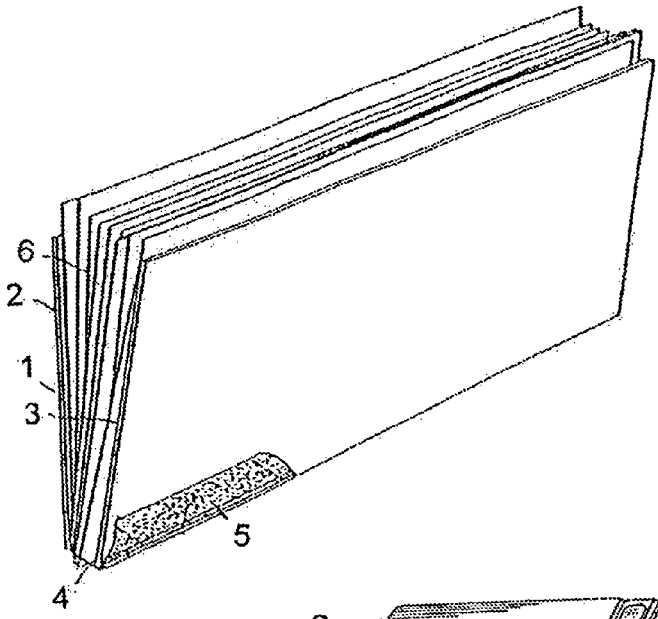
FIG. 1 is a perspective view of a booklet of a kind intended for production in the binding machine.

FIG. 1 is a perspective view of a booklet of a kind that can be produced with the aid of a binding machine and with the aid of a method according to the invention. The booklet comprises a booklet cover 1 that has a front side 2, a rear side 3 and a spine 4 disposed between said sides. The booklet includes a number of paper sheets 6 glued to the spine. To this end the inner surface of the spine is provided with a glue layer 5 as will be seen from the figure, by virtue of part of the rear side 3 of the cover and the paper sheets having been cut away in the figure. Booklet covers are provided for binding such booklets. A booklet cover suitable for binding in accordance with the present invention is illustrated in perspective in FIG. 2. The booklet cover 1 is provided as a generally planar unit where one half is intended to form the front side 2 of the booklet and the other half 3 is intended to form the rear side of the booklet with a small central narrow part which forms the spine 4 of the booklet.

The figure illustrates that side of the booklet cover 1 which, after binding, is intended to form the inside of the booklet. The spine 4 is delimited with regard to the front and the rear sides 2, 3 of the booklet by a respective fold line 6, 7. A layer of adhesive 5 is applied to the inside of the spine 4 between said fold lines. The adhesive is of a kind that is rigid at room temperature and thus lacks adhesiveness in a cold state. The adhesiveness of the adhesive is activated by heating the same. A glue joint is established by subsequently allowing the adhesive to cool. As will be evident from the above description, the booklet cover 1, when flat, has a width, i.e. the extension in the direction of the fold lines, that corresponds generally to the height of the paper sheets to be bound in the folder and a length which is somewhat greater than the width of the sheet. For example, for binding A4-sheets the booklet cover will have a size which is slightly larger than A3.

Figure 2:
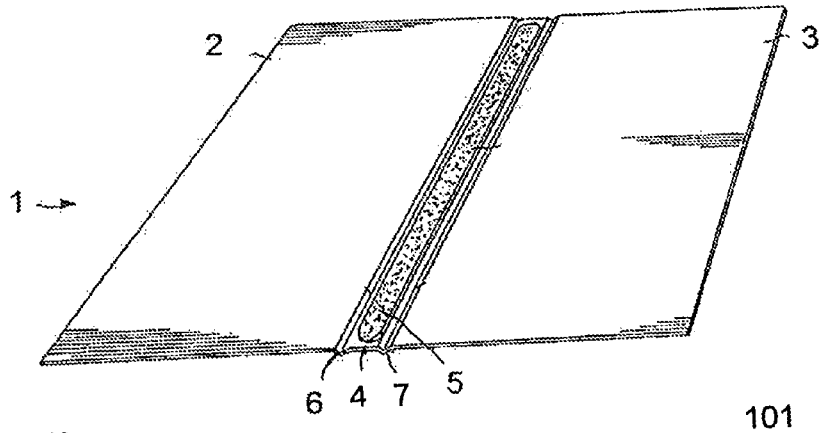
FIG. 2 is a perspective view of a booklet cover.

Binding of a booklet is achieved by feeding a booklet cover into the binding machine from a cassette that contains a bundle of flat booklet covers, as shown in FIG. 2.

The booklet cover 1 is bent in the binding machine through an angle slightly smaller than 90° along each fold line, wherewith the booklet cover obtains a V-like shape. The paper sheets 8 that are to form a booklet are inserted into the thus folded booklet cover so that one longitudinal edge of each paper sheet will lightly abut the strip of adhesive 5. The spine 4 of the booklet cover coated with the adhesive layer 5 is then heated so as to soften the adhesive, wherein the end edge of each paper sheet 8 penetrates into the adhesive layer 5.

The booklet is then allowed to cool, so that the paper sheets become fixed to the inner surface of the spine 4 and therewith resulting in a finished booklet.

Figure 3:
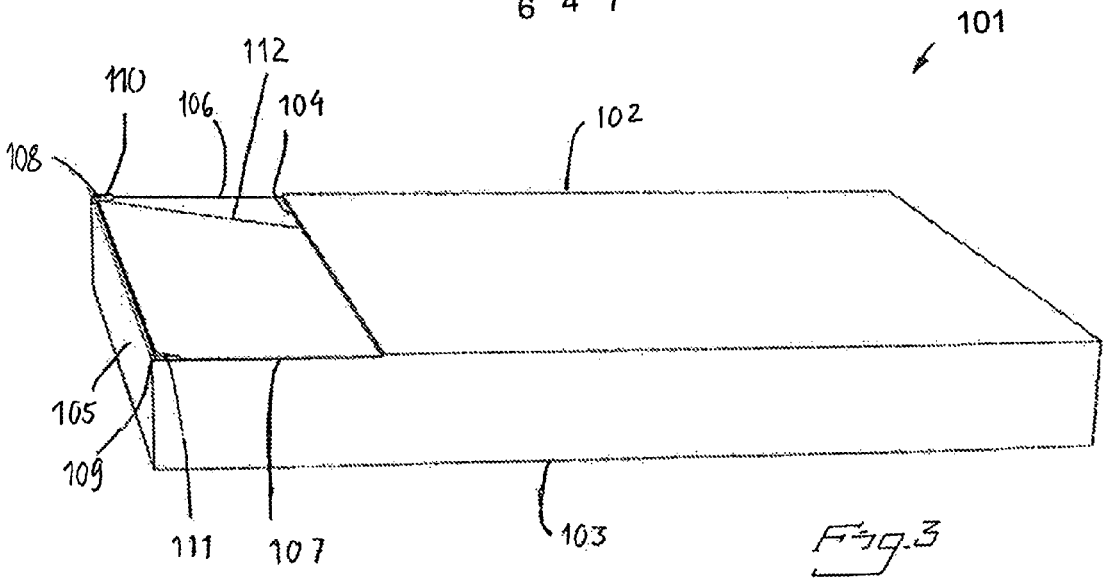
FIG. 3 is a perspective view of an infeed cassette according to the invention.

FIG. 3 illustrates a cassette 101 in which a bundle of booklet covers 1 is delivered and stored in a non-folded state, as illustrated in FIG. 2. For the sake of clarity, the figure shows an empty cassette. The cassette also constitutes an infeed cassette that is connected to the binding machine. The cassette 101 has a parallelepipedic box-like shape with a length and a width corresponding to a non-folded booklet cover 1 and a height adapted to an appropriate bundle size, for instance the size of 50-100 booklet covers.

The cassette 101 has a feed side or top side 102 and a bottom side 103 located centrally opposite the top side 102. The feed side includes an opening 104 through which the booklet covers 1 are fed into the binding machine in a direction out to the left in the figure. The opening 104 extends entire left end of the cassette as seen in the figure and is there delimited by an opening edge 105. Separating elements 110, 111 are disposed in the corners 108, 109 defined between the opening edge 105 and the laterally located opening edges 106, 107. Each separating element is comprised of a thin triangular plate 111, 112.

In certain application it might be sufficient with only one of the separating elements 110, 11. The separating elements do not necessarily have to have triangular shape, they can e.g. be shaped as a quarter of a circle. Nor is it necessary that the extension of each separating element along the opening edge 105 is equal as its extension along the respective laterally located opening edge 106, 107.

Each separating element extends along the respective edge 105, 106, 107 a distance in the range 3-30 mm, preferably in the range 5-15 mm.

Separating the overmost sheet in a bundle of sheets in the cassette is performed in that a feeding device associated with the machine affects the overmost sheet with a force or in the leftward direction in the figure or upwards or in a direction therein between. The force can be applied by friction, suction or in some other way. The separating elements 110, 111 thereby initially prevents the sheet from being fed out. Instead the applied force will force the sheet to bulge upwardly so that bending tensions will occur in the sheet. By the spring action resulting from these tensions each corner of the sheet after a while will slip across the respective separating element 110, 111 upwardly so that the sheet becomes free and becomes separated from the other sheets, and thereafter it is free to be fed into the machine.

The bundle of booklet covers are supported in the cassette 101 by means of a movable support plate 112. The entire cassette 101, including the triangular separating means 110, 111 and the support plate 112 are comprised conveniently of cardboard e.g. corrugated cardboard.

Figure 4:
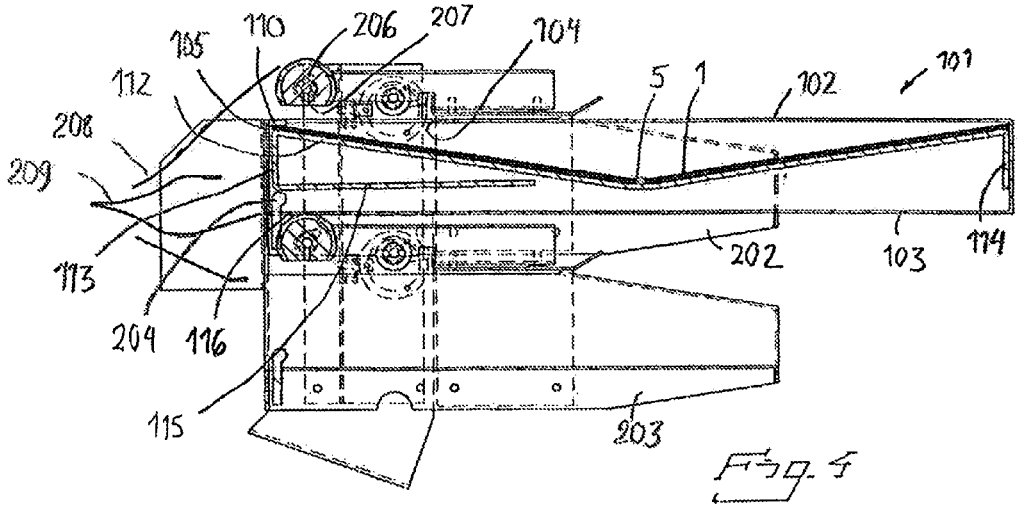
FIG. 4 is a longitudinal sectioned view of the cassette shown in FIG. 3.

FIG. 4 is a longitudinal sectioned view of a cassette 101 and that part of the binding machine that forms the cassette receiving means. The cassette receiving means is comprised of two compartments 202, 203 each of which is adapted to enable a cassette 101 to be inserted there into. The two cassette compartments are generally identical. The purpose of two compartments is to have a prepared cassette in one compartment when the other compartment is empty. As will be understood, the invention can also be applied with the aid of a single compartment or with more than two compartments.

The figure shows only the upper compartment 202 with a cassette 101 inserted. The cassette is of the kind shown in FIG. 3, having a feed side 102, a bottom side 103 and a feed opening 104. FIG. 4 illustrates how the support plate 112 is arranged. The plate extends over the full length and width of the cassette and is slightly angled at its centre. The bundle of booklet covers then rests on the support plate. The support plate has at each end a downwardly directed end portion 13, 114, and the end part 13 located adjacent the feed opening 104 continues in a rearward deviating part 115. The bottom side 103 includes an opening 116 which enables a pressure element 204 to extend into the cassette.

The above described cassette 101 can be used also for feeding out other kind of sheets than unfolded booklet covers. It can be used also for folded covers as well as for sheets, e.g. paper sheets in general. In the latter case it can function as a feeding cassette to various kinds of machines, e.g. copy machines and printers. A cassette of the described kind preferably also fulfills the purpose as shipping and storing cassette and is in that case intended as a single use article.

If the cassette is for reuse the sheets are preferably delivered and stored in another kind of package. In that case the cassette is preferably made of a more durable material than cardboard, e.g. plastic or metal sheet.

There is located at the part of the binding machine shown in FIG. 4 an infeed mechanism which includes a feed roller 206 and a spring-biased pressure element 204. A booklet cover is fed into the machine by rotating the feed orator 6 and applying the roller to the uppermost booklet cover 1 in the bundle at the same time as the spring biased pressure element 204 presses the bundle of booklet covers 1 up towards the feed roller 206 via the support plate 112. The feed roller rotates clockwise and has a frictional surface around the major part of its periphery, which trains the uppermost booklet cover 1 in the bundle by means of friction, at the same time as the spring biased pressure element 204 presses the bundle of booklet covers 1 up towards the feed roller via the support plate 112. The feeding movement from the feed roller 206 in combination with the upwardly direction pressure force from the pressure element 204 forces the uppermost booklet cover to be slightly deformed, so that its slip past the triangular separating elements 102, 111. These elements also prevent the nearest underlying booklet cover to accompany the movement of the uppermost booklet cover 1.

Part of the periphery of the feed roller 206 is cut away such as to form a planar surface 207. The purpose of this portion of the periphery is to allow the passage of the glue strip 5 on the booklet cover 1, by synchronizing rotation of the feed roller 206 so that it will be in the position shown in figure when the glue strip 5 has reached this position. At this stage of the procedure, the front part of the booklet cover 1 has already reached and been gripped by feed means farther in the binding machine.

Figure 5:
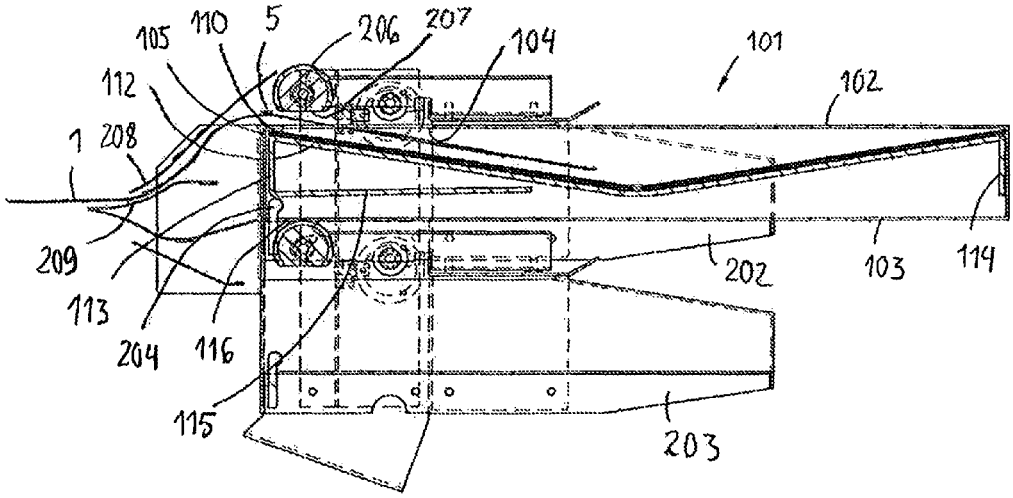
FIG. 5 is a sectional view similar to FIG. 4 and illustrates a later stage of the infeed process.

FIG. 5 is a longitudinal sectioned view corresponding to the view of FIG. 4, although with the single difference that it shows a position in which the upper most booklet cover 1 has been fed half way into the binding machine. Guide plates 208, 209 are disposed to guide movement of the booklet covers into the binding machine.

Figure 6:
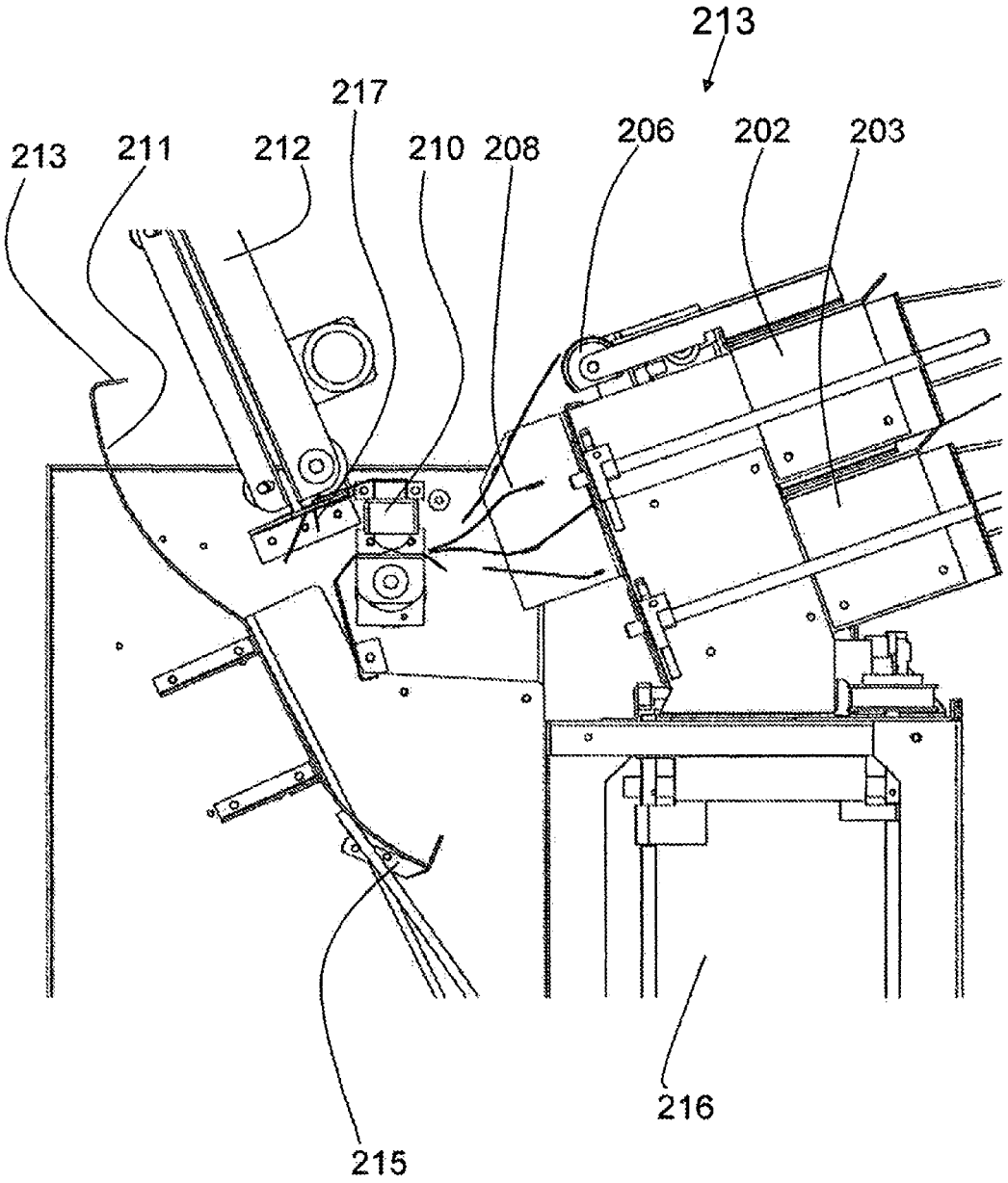
FIG. 6 is a side view, partly in section, of a binding machine according to the invention.

Those parts of the binding machine 201 important with regard to an explanation of the present invention are disposed in FIG. 6, which is partially a side view and partially a longitudinal view of the machine. Each booklet cover that is fed-in from the cassette in one of the compartments 202, 203 is guided-in towards a feed head 210, where the guide plates 208, 209 guide the map covers from the cassette in the upper compartment. The feed head 210 feeds the booklet cover towards i.e. guide plate 211 to cause the cover to be folded, as will be described in more detail with reference to FIGS. 7-9. The machine includes an infeed mechanism 212 for feeding paper sheets to the booklet cover. There is provided in the lower part of the machine an activating unit 216 in which the adhesive in the booklets is heated up, and the cooling unit.

Figure 7:
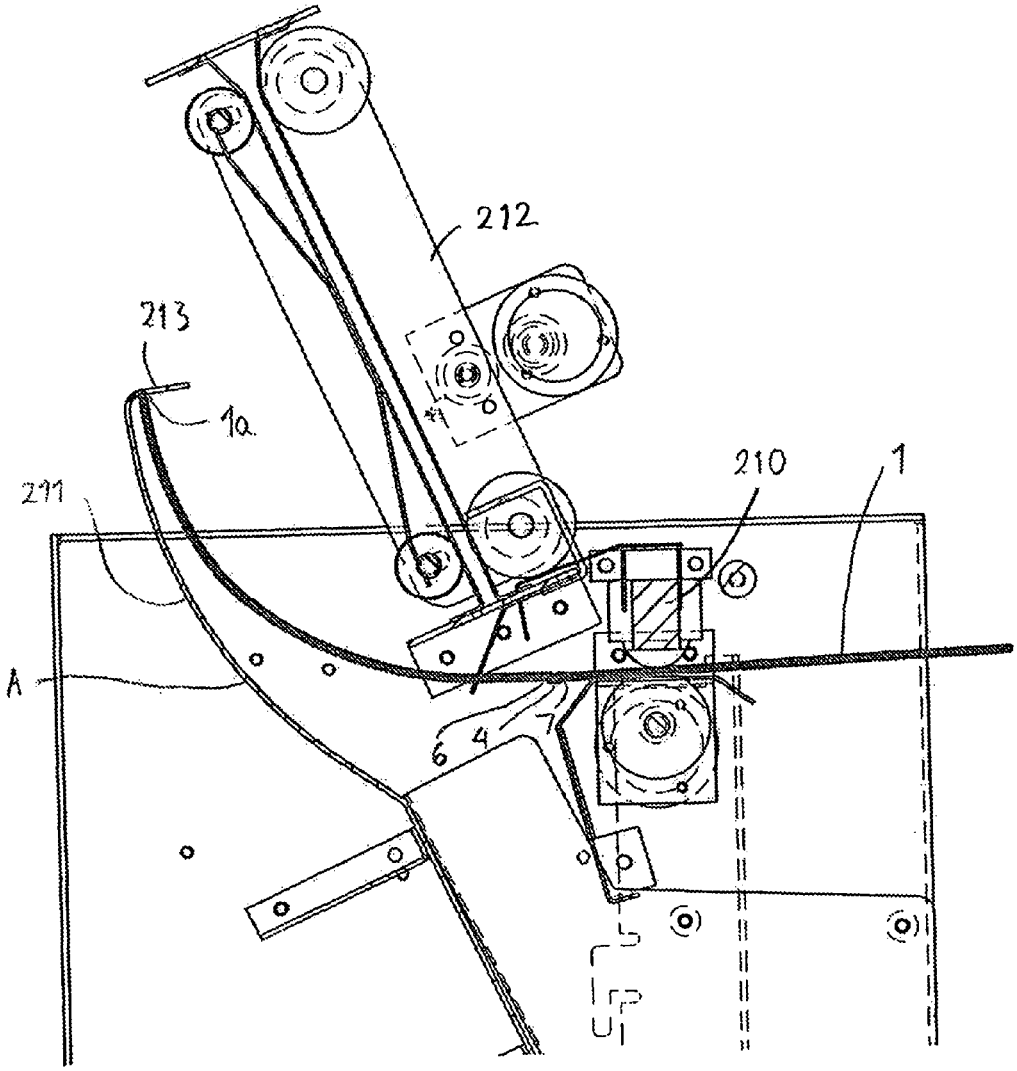
FIGS. 7-9 are respectively enlarged detailed views of FIG. 6 and illustrate different stages of the binding sequence.

FIG. 7 is an enlarged detailed view of FIG. 5 and illustrates a booklet cover 1 in a first stage of the folding operation. In this stage of the procedure, the feed head 210 has caused the leading end edge 1A of the booklet cover to strike the guide plate 211 roughly at point A. As a result of the curved probooklet of the guide plate, continued advancement of the booklet cover forces the end edge 1*a* to wander up along the probooklet until further movement of the end edge 1*a* is prevented by a flange 213 on the guide plate 211.

Figure 8:
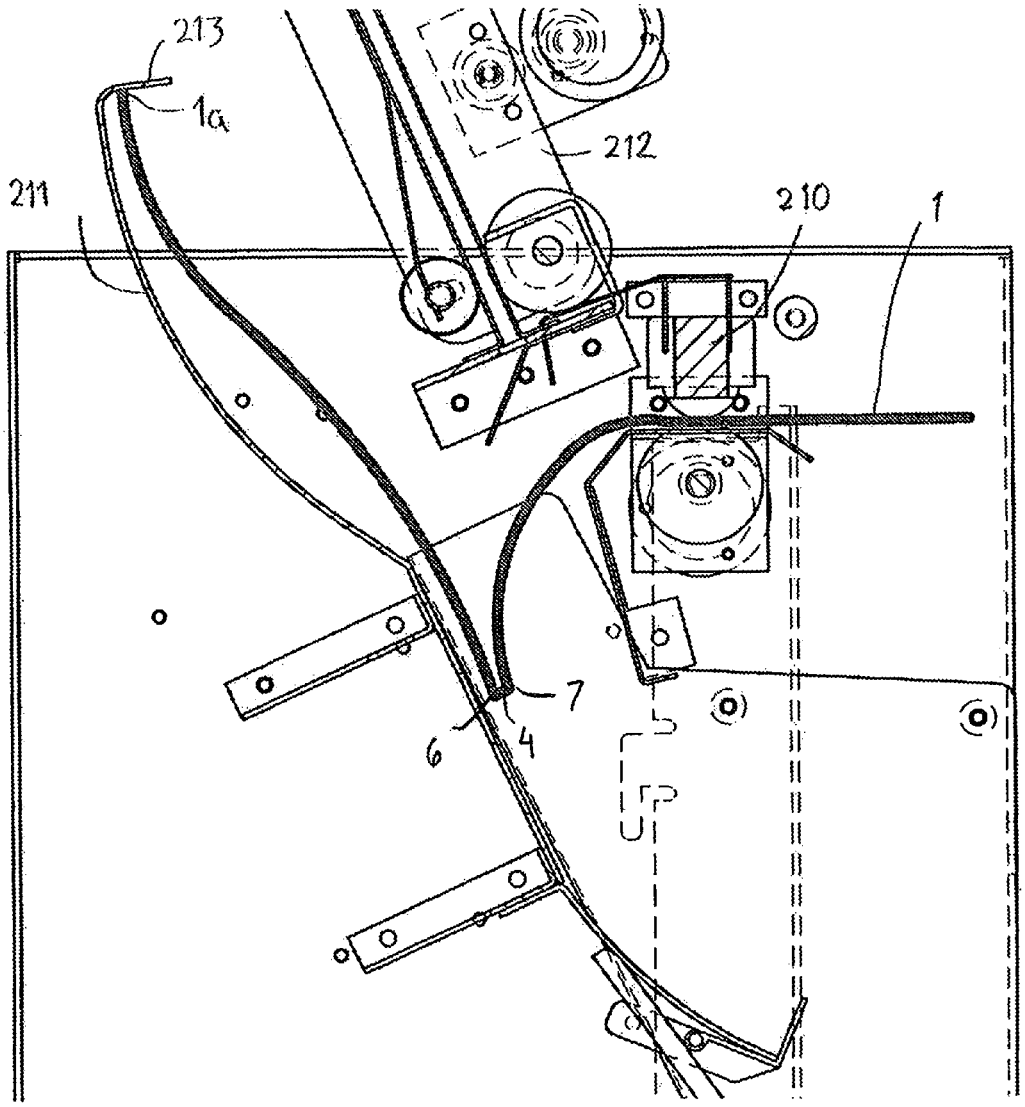

FIG. 8 is a view corresponding to the view on FIG. 7 and illustrates the booklet cover 1 in a second stage of the folding sequence. When the feed head 210 continues to feed the booklet cover 1 to the left subsequent to the end edge 1*a* having struck against the flange 213, the feed force and counter force from the flange 213 force the booklet cover to fold along a first fold line 6. During the movement from the position shown in FIG. 7 to the position shown in FIG. 8, the region around the spine will be forced to move downwards at the same time as the booklet cover is also forced to fold along the second fold line 7, so that the booklet cover will gradually take the position shown in FIG. 8.

Figure 9:
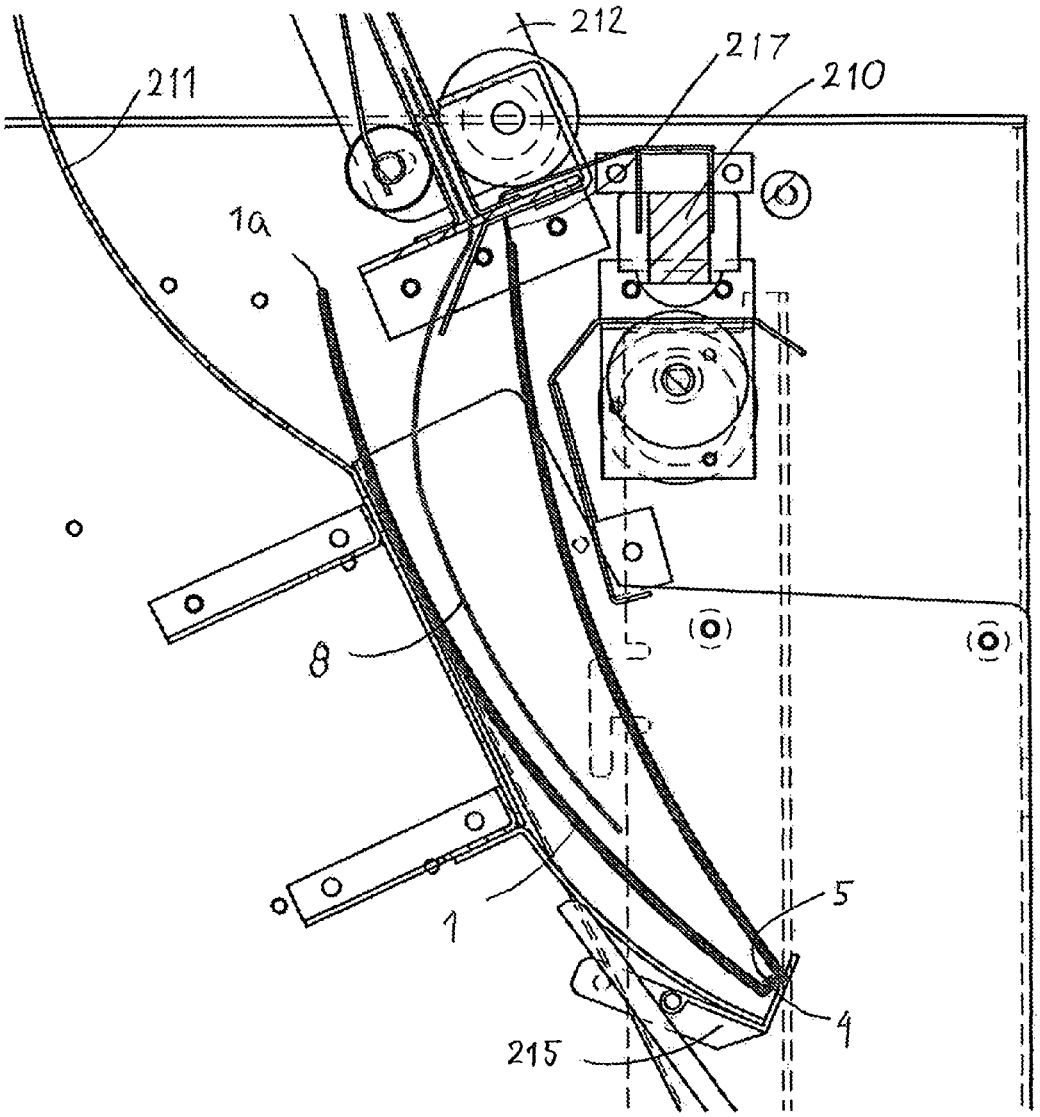

Continued infeed of the remaining part of the booklet cover forces the lower part of the booklet cover, i.e. the spine adjacent region, is forced to move downwards and finally takes the position shown in FIG. 9, in which the folding sequence is terminated. The booklet cover 1 is captured by a support hook 215 when folding of the cover is complete. The booklet cover is held in a slightly outwardly angled position due to the fact that a stop flange 217 holds out the trailing end edge 1*b* of the booklet cover. When the booklet cover has reached this position, it is prepared to receive the paper sheets to be bound in the cover. This is carried out by the sheet feed mechanism 212. This mechanism feeds the paper sheets into the booklet cover one at a time.

FIG. 9 illustrates how a paper sheet 8 is about to be fed into the booklet cover 1. Subsequent to having fed the desired number of sheets into the cover with their respective end edges in abutment with the glue strip on the inside of the booklet cover, the whole assembly is ready for the actual binding sequence. The booklet cover 1, with its enclosed paper sheets 6, is therewith released from the support flange 215 so that the booklet cover and its enclosed paper sheets will fall down in the activating unit 216 under the force of gravity, or is fed into the activating unit by means of a special drive mechanism. Continuation of the process is of a conventional kind and is not thought to require any particular explanation. Thus, the adhesive on the inside of the spine is conventionally heated in the activating unit, so that the end edges of respective sheets will penetrate in the viscous adhesive.

Subsequent to allowing the glue to solidify, the paper sheets will be bound to the booklet cover to provide a finished booklet.

The invention claimed is:

1. A booklet binding machine where each booklet includes a cover that has a front side, a rear side, a spine disposed between said front and rear sides and a number of sheets enclosed in the cover and glued to the spine thereof, the machine comprising:

a cassette receiving element that receives a cassette pack comprising a cassette and a bundle of booklet covers disposed in the cassette, each booklet cover being provided with fold lines and an activatable adhesive between the fold lines;

an infeed mechanism that feeds booklet covers from the cassette to the machine, one at a time;

a combining unit that combines a plurality of sheets with an infeed booklet cover; and an activating unit that activates the adhesive so that ends of the sheets penetrate the adhesive and thereby are fastened to the booklet cover;

the cassette receiving element receiving a cassette pack in which the booklet covers are disposed in a bundle of non-folded state in the cassette; the machine also including a folding device for folding the booklet covers along two of said fold lines, the folding means folding a booklet cover prior to the sheets being combined with the booklet cover, such that the combination of the sheets with the booklet cover implies that the sheets are inserted into said folded booklet cover.

2. The A-binding machine according to claim 1, wherein folding device includes a guide plate which is adapted to guide a leading end edge of the booklet cover in a given movement path.

3. The binding machine according to claim 2, wherein the guide plate includes at least one part which is curved in a plane perpendicular to the direction of movement of said end edge and with the concave side of the plate facing towards said end edge.

4. The binding machine according to claim 2, wherein the guide plate includes a stop device for stopping movement of said end edge prior to the booklet cover being fully fed-in.

5. The binding machine according to claim 1, wherein the machine is adapted to combine one sheet at a time with the booklet cover.

6. The binding machine according to claim 1, wherein the infeed mechanism includes a feed roller which is adapted to roll in abutment with one side of the outer most booklet cover of the booklet cover bundle, and a resilient pressure element which is adapted to press against the opposite side of the booklet cover bundle.

7. A-cassette pack which includes an infeed cassette and a bundle of booklet covers in the cassette, the cassette pack being connected to a binding machine according to claim 1, the booklet covers in the cassette pack being in a non-folded state and each being provided with two fold lines and an activatable adhesive.

8. The cassette pack according to claim 7, wherein the cassette is generally in the form of a parallelepipedic box that has a feed side and an opposing bottom side, wherein the feed side includes a feed opening, wherein the feed opening includes means for separating a booklet cover from remaining booklet covers in the bundle.

9. The cassette pack according to claim 8, wherein the feed opening is delimited by a first opening edge adjacent one end of the feed side, wherein the first opening edge defines a corner with each laterally disposed opening edge, wherein there is fastened in at least one of the corners an element which projects out slightly into the feed opening and constitutes said separating element.

10. The cassette pack according to claim 8, wherein said bottom side includes an opening which permits the passage of a pressure element disposed in the binding machine.

11. The cassette pack according to claim 8, wherein the cassette includes a movable support plate disposed between the bundle of booklet covers and the bottom side.

12. The cassette pack according to claim 8, wherein the feed opening is adapted to permit the feed of the booklet covers in a direction perpendicular to the fold lines.

13. The cassette pack according to claim 7, wherein the cassette is adapted to also form a packaging means for the bundle of booklet covers.

14. A booklet binding method where each booklet includes a cover that has front side, a rear side, a spine disposed between said sides, and a number of sheets enclosed in the cover and glued to the spine of the cover, the method comprising the steps of:

feeding the booklet covers from a cassette to a binding machine one at a time, each booklet cover including fold lines and an activatable adhesive between the fold lines;

activating the adhesive so that ends of the sheets penetrate the adhesive and thereby are fastened to the booklet cover;

feeding each booklet cover into the machine in a non-folded state; and folding each booklet cover in the machine prior to the sheets being combined with the booklet cover, such that the combination of the sheets with the booklet cover implies that the sheets are inserted into said folded booklet cover.

15. The method according to claim 14, wherein the method is carried out with the aid of a binding machine comprising:

a cassette receiving element that receives a cassette pack comprising a cassette and a bundle of booklet covers disposed in the cassette, each booklet cover being provided with fold lines and an activatable adhesive;

an infeed mechanism that feeds booklet covers from the cassette to the machine, one at a time;

a combining unit that combines a plurality of sheets with an infeed booklet cover;

an activating unit that activates the adhesive and therewith fastens the sheets to the booklet cover;

the cassette receiving element receiving a cassette pack in which the booklet covers are disposed in a bundle of non-folded state in the cassette; and a folding device for folding the booklet covers along two of said fold lines.

16. The method according to claim 14, wherein the method is carried out with the aid of a cassette pack comprising:

an infeed cassette, and a bundle of booklet covers in the cassette, the cassette pack being connected to a binding machine, the booklet covers in the cassette pack being in a non-folded state and each being provided with two fold lines and an activatable adhesive, the binding machine comprising:

a cassette receiving element that receives a cassette pack comprising a cassette and a bundle of booklet covers disposed in the cassette, each booklet cover being provided with fold lines and an activatable adhesive;

an infeed mechanism that feeds booklet covers from the cassette to the machine, one at a time;

a combining unit that combines a plurality of sheets with an infeed booklet cover;

an activating unit that activates the adhesive and therewith fastens the sheets to the booklet cover;

the cassette receiving element receiving the cassette pack in which the booklet covers are disposed in a bundle of non-folded state in the cassette; and a folding device for folding the booklet covers along two of said fold lines.

17. The binding machine according to claim 1, wherein the activatable adhesive between the fold lines is heat activatable.

18. The method according to claim 14, wherein the activatable adhesive between the fold lines is heat activatable.

* * * * *